United States Patent [19]

Sevastakis

[11] Patent Number: 4,535,832

[45] Date of Patent: Aug. 20, 1985

[54] CONTINUOUS CASTING APPARATUS

[76] Inventor: Gus Sevastakis, 5645 Angola Rd., Toledo, Ohio 43615

[21] Appl. No.: 559,276

[22] Filed: Dec. 8, 1983

Related U.S. Application Data

[63] Continuation-in-part of Ser. No. 258,590, Apr. 29, 1981, abandoned.

[51] Int. Cl.[3] ..... B22D 11/00; B22D 11/04

[52] U.S. Cl. ..... 164/421; 164/443; 164/465

[58] Field of Search ..... 164/421, 443, 464, 465, 164/485, 348

[56] References Cited

U.S. PATENT DOCUMENTS

| | | | |
|---|---|---|---|
| 2,169,893 | 8/1939 | Crampton et al. | 164/443 X |
| 2,176,990 | 10/1939 | Crampton | 164/443 X |
| 2,527,545 | 10/1950 | Goss | 164/443 X |
| 2,613,411 | 10/1952 | Rossi | 164/443 |
| 3,447,592 | 6/1969 | Wertli | 164/443 |
| 3,527,287 | 9/1970 | Huber | 164/443 |
| 3,595,302 | 7/1971 | Mallener | 164/443 |
| 3,978,910 | 9/1976 | Gladwin | 164/443 |
| 4,000,773 | 1/1977 | Sevastakis | 164/421 |
| 4,471,830 | 9/1984 | Sevastakis | 164/465 X |

*Primary Examiner*—Nicholas P. Godici
*Assistant Examiner*—J. Reed Batten, Jr.
*Attorney, Agent, or Firm*—William E. Mouzavires

[57] ABSTRACT

For use in a continuous casting apparatus wherein molten metal flows through a die progressively and is solidified in the die and withdrawn from the die, a die and cooling assembly comprising a tubular die having an external tapered surface which is uniformly tapered radially inwardly in the direction of movement of metal to the die, a cooling sleeve having an internal surface complementary to the external surface of the die and in substantial contact with the external surface of the die and an annular cooling jacket wall surrounding the cooling sleeve and having portions thereof spaced from the sleeve to define a cooling chamber. At least one coolant inlet is provided to the chamber and at least one coolant outlet is provided from the chamber. The inlet and outlet are spaced axially with the outlet being nearest the upper end of the die where the molten metal enters the die and the inlet being nearest the lower end of the die where the solidified metal leaves the die. The cooling sleeve has a plurality of circumferentially spaced integral ribs extending radially outwardly therefrom into close proximity to the inner surface of the cooling jacket wall such that coolant flows in a thin layer along the inner surface of the cooling jacket and in a plurality of axial paths along the surfaces of the ribs. The ribs are of progressively increasing height circumferentially about the cooling sleeve from the area of the coolant inlet to the area of the coolant outlet.

22 Claims, 9 Drawing Figures

CONTINUOUS CASTING APPARATUS

RELATED APPLICATION

This application is a continuation-in-part of my prior copending application Ser. No. 06/258,590 filed Apr. 29, 1981 and entitled "Continuous Casting Apparatus" and now abandoned.

BACKGROUND AND OBJECTS OF THE INVENTION

The present invention relates to continuous casting of finished products, for example, bronze castings, and more specifically to novel method and apparatus for cooling the product and the casting apparatus. The present invention is particularly suited to continuous, vertical, casting wherein the molten metal is fully solidified within the forming die, that is, prior to removal from the die.

In continuous casting of metals such as brass and the like, it is common to permit molten metal to flow from a crucible through a die which is surrounded by a cooling apparatus so that the molten metal progressively solidifies during a dwell period after which it is withdrawn by suitable apparatus. A major consideration in the efficiency of such a device is the ability to remove heat from the die.

In my U.S. Pat. No. 4,000,773, apparatus for cooling the die is shown which utilizes a cooling sleeve having intimate contact with the exterior surface of the die, which cooling sleeve is externally cooled by flowing coolant about the periphery thereof. Inasmuch as the coolant that first contacts the cooling sleeve is cold and progressively increases in temperature, there is a tendency for the cooling sleeve to be cooled unevenly and expand out of intimate contact with the die. Additionally, the incoming coolant does not uniformly contact the entire outer surface of the sleeve and the inner surface of the jacket but rather flows along a diagonal direction from the coolant inlet to the coolant outlet whereby uneven cooling of the product, die and cooling apparatus further results. Uneven cooling causes grain and strength imperfections in the cast product, while also leading to premature rupture of the forming dies and damage to the cooling apparatus. Additionally, uneven cooling often adversely affects the dimensions of the product, particularly tubular products and the diametrical dimensions of the internal passage thereof. Because of the flow path of the coolant as noted above, solidification of the molten metal within the die does not occur in the same predetermined horizontal plane which, under ideal cooling conditions, determines the diameter of the casting including the internal diameter of a tubular casting.

One of the objects of the present invention is to provide novel methods and apparatus for improving the quality of a continuously cast finished product to give it uniform strength and grain characteristics as well as accurate dimensioning.

Another object is to provide novel methods and apparatus for increasing the rate of production of continuous casting operations wherein molten metal is introduced into a forming die, fully solidified in the die and then removed from the die as a solidified finished casting and wherein the aforementioned steps are continuously repeated. Included herein are such methods and apparatus that will significantly increase the rate of production in commercial casting operations without sacrificing the quality of the cast product.

A further object of the present invention is to provide novel methods and apparatus for distributing and controlling the flow of coolant in continuous casting apparatus to enable increased and uniform heat extraction from the casting being formed and its associated forming die to thereby improve the strength and grain structure of the product while prolonging the useful life of the die and associated cooling apparatus. Included herein are such methods and apparatus which will permit the molten metal to uniformly solidify within the forming die in substantially the same plane which extends generally perpendicular to the direction of metal flow through the die and which, in vertical casting operations, extends horizontally. Further included herein are such methods and apparatus which also enable cylindrical products to be cast with precise diameters including internal diameters in the case of tubular products.

A further object of the present invention is to provide novel and improved cooling apparatus for continuous casting operations of the type described above and which may be used to achieve the above objects. Included herein is a novel cooling sleeve received within a cooling jacket and while intimately receiving the forming die and having a novel external rib configuration for controlling the flow of coolant and heat transfer particularly at the "freezing" zone of the molten metal, that is, the area at which the molten metal solidifies in the die. Included herein is such a novel cooling sleeve that will also distribute coolant to uniformly extract heat from all portions of the forming die to prolong the life of the die as well as the cooling sleeve and the surrounding cooling jacket.

SUMMARY OF THE INVENTION

In accordance with the invention, the die and cooling assembly comprises a tubular die having an external tapered surface which is uniformly tapered radially inwardly in the direction of movement of metal to the die, a cooling sleeve having an internal surface complementary to the external surface of the die and in substantial intimate contact with the external surface of the die, an annular cooling jacket wall surrounding the cooling sleeve and having portions thereof spaced from the sleeve to define a cooling chamber, at least one coolant inlet to said chamber and at least one coolant outlet from said chamber. The inlet and outlet are spaced axially with the outlet being nearest the upper end of the die where the molten metal enters the die and the inlet being nearest the lower end of the die where the solidified metal leaves the die. The cooling sleeve has a plurality of circumferentially spaced integral ribs extending radially outwardly therefrom into close proximity to the inner surface of the cooling jacket such that coolant flows in a thin layer along the entire inner surface of the cooling jacket and in a plurality of axial paths along the surfaces of the ribs. Thus, the incoming fresh coolant contacts the entire surface of the sleeve and the surrounding jacket. Moreover, the ribs are of progressively increasing height circumferentially about the cooling sleeve from the area of the coolant inlet to the area of the coolant outlet, thereby providing progressively greater cooling area and uniform exchanges as the coolant increases in temperature in moving over the cooling sleeve from the inlet to the outlet. This allows the molten metal to solidify along a freeze line in a iametrical plane perpendicular to the direction of flow through the die. The ribs also increase the radiating area r heat dissipation to further accelerate the heat transfer o the cooling fluid.

The cooling sleeve with the extended vertical ribs is preferably fabricated from high conductivity material such as deoxidized copper which is well-known for its superior thermoconductivity. The vertical ribs not only increase the cooling area of the copper sleeve but serve also as a restrictor to minimize the expansion of the sleeve during operation so the graphite die is maintained in intimate contact with the cooling areas of the copper sleeve. The water circulating on the outside of the ribs cools them more than the inside area and thus provides superior holding power to resist the deformation of the cooling sleeve. The cooling fluid as it circulates from the lower portion of the cooling sleeve over the vertical ribs forms a plurality of columns of water of varying different temperatures. As the water enters the bottom of the vertical ribs the heat transferred to the water has the tendency to hold the expansion of the cooler sleeve so there is no deformation of the contacting area between the die and the cooling sleeve. The outer surface of the vertical water columns and the layer of water between the tips of the ribs and the external shell also cools the shell, which is preferably made of steel and which holds the cooling sleeve and restricts expansion of the cooling sleeve.

DETAILED DESCRIPTION

Figure 1:
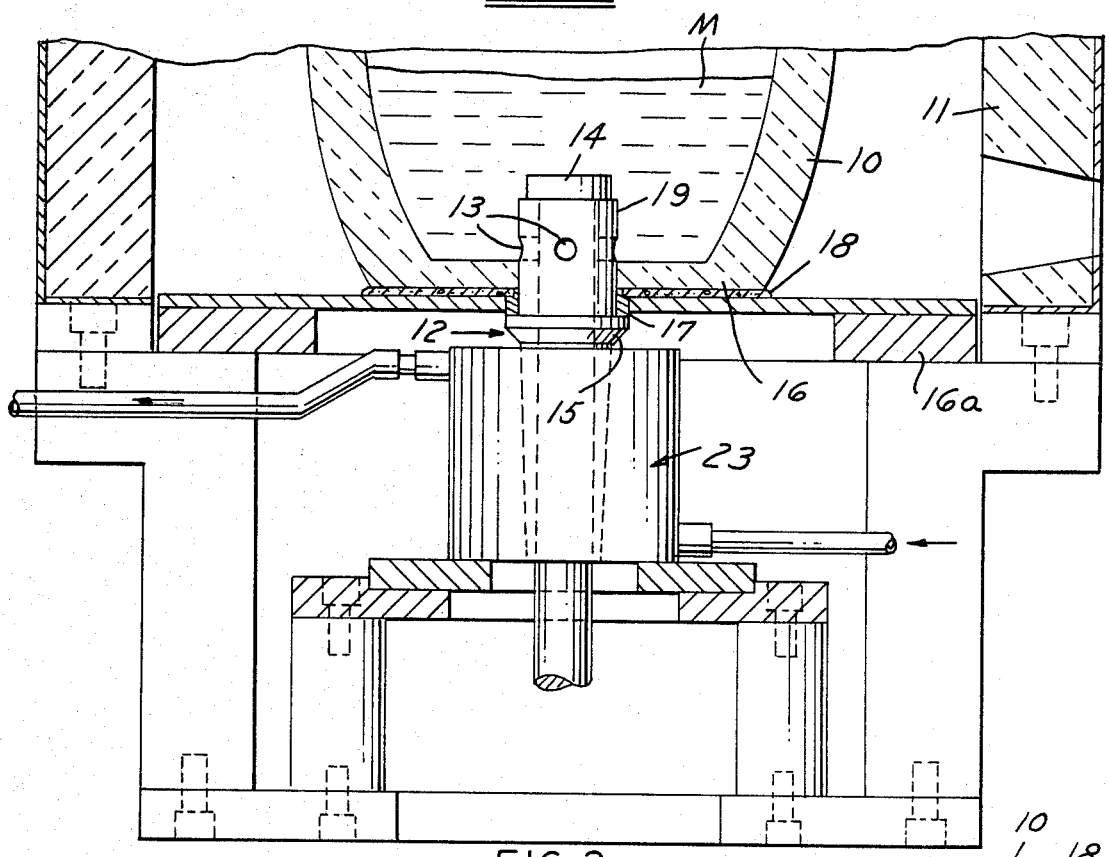
FIG. 1 is a part sectional elevational view of a continuous casting apparatus embodying the invention.

Referring to FIG. 1, the invention relates to a continuous casting apparatus which conventionally includes a crucible 10 that contains molten metal M and is kept heated in a furnace 11 which is fired by burners (not shown). In a vertical casting apparatus as shown, the molten metal flows through the upper end of a tubular die 12 through openings 13 and as it moves through the die progressively solidifies in the die during a dwell period after which it is withdrawn downwardly by intermittently driven withdrawal apparatus such as pinch rolls (not shown). A tapered mandrel 14 may be provided in the event that tubular forms are being made in which event the internal diameter of the casting will correspond to the diameter of the mandrel at the freezing line where the molten metal solidifies.

The die 12 is made of graphite and includes an intermediate flange 15 for providing a seal with the lower end 16 of the crucible 10. Suitable cement 17 is interposed between the upper surface of the flange and the bottom 16 of the crucible. In addition, cement 18 is interposed between the bottom of the crucible and the supporting plate of the bottom 16*a* of the furnace. Crucible 10 is formed with an opening through which the upper end of die extends.

The internal surface 20 of the die 12 is cylindrical for forming circular products and the lower portion 21 of the die has an outer tapered surface 22 that tapers radially inwardly in the direction of movement of the metal.

The cooling assembly 23 comprises a cooling sleeve 24 that has an internal tapered surface 25 complementary to the die surface 22 so that there is substantial intimate surface-to-surface contact between the tapered surfaces 22, 25 of the die 12 and the cooling sleeve 24.

The cooling sleeve 24 includes integral upper and lower flanges 26, 27 that extend radially outwardly and are engaged by a shell 28 which is welded as at 29, 30 to the outer surfaces of the flanges 26, 27. The outer surfaces of the cooling sleeve 24 is cylindrical and is formed with a plurality of axially extending grooves defining a plurality of circumferentially spaced ribs 34 extending radially outwardly into close proximity but in spaced relationship to the inner cylindrical surface of the jacket wall 28. Each rib includes a flat end 35 and tapered side surfaces 36.

The ribs extend along the cylindrical outer surface of the sleeve but are spaced from the flanges 26, 27 to define secondary chambers 37, 38. The cooling assembly is further formed with spaced inlets 39, 40 that have their axes parallel to and on each side of a radial plane through the axis of the die so that coolant such as water entering through the inlets is caused to flow in opposite directions through the chamber 38. The assembly 23 further includes an outlet 41 at the upper end of the cooling assembly 23 which extends along a radius and intersects the chamber 37.

As previously indicated, the die 12 is preferably made of graphite, the cooling sleeve 24 is preferably made of deoxidized forged copper, which is well-known to have high thermal conductivity, and the cooling shell 28 is preferably made of steel.

The ribs 34 are of progressively increasing height circumferentially about the cooling sleeve 24 from the area of the coolant inlet to the area of the coolant outlet. In other words, the grooves that define the ribs increase in depth progressively circumferentially about the sleeve 24 from the area of the coolant inlet to the area of the coolant outlet. Since the tips of the ribs 34 lie on a cylindrical surface, the radial cross sectional thickness of the sleeve to the base of each rib is greater and progressively decreases circumferentially from the area of the coolant inlet to the area of the coolant outlet. Thus as shown, for example in FIGS. 2 and 3, the radial thickness a of the sleeve 24 from the interior surface 25 to the base of ribs 34 near the area of coolant inlet is greater than the radial thickness b in the same plane at an area diametrically opposite. As a result, as the coolant increases in temperature in moving over the cooling sleeve, a progressively greater cooling area is presented and the interchange of heat is made more uniform so that a substantially equal amount of heat is extracted from the cooling sleeve and die at all locations or levels along the die so that intimate contact is maintained between the cooling sleeve and the die. Moreover, this allows the molten metal to solidify in the same horizontal plane at a predetermined level along the mandrel 14 at which point the diameter of the mandrel determines the diameter of the interval passage of the casting. It is important to the achievement of the desired internal diameter of the casting that the metal solidfy in the same horizontal plane. The latter is also important to avoid residual molten metal that would otherwise remain on the inner surface of the die and harden where it would later cause indentations and surface irregularities on the cast product subsequently formed at that location.

Figure 2:
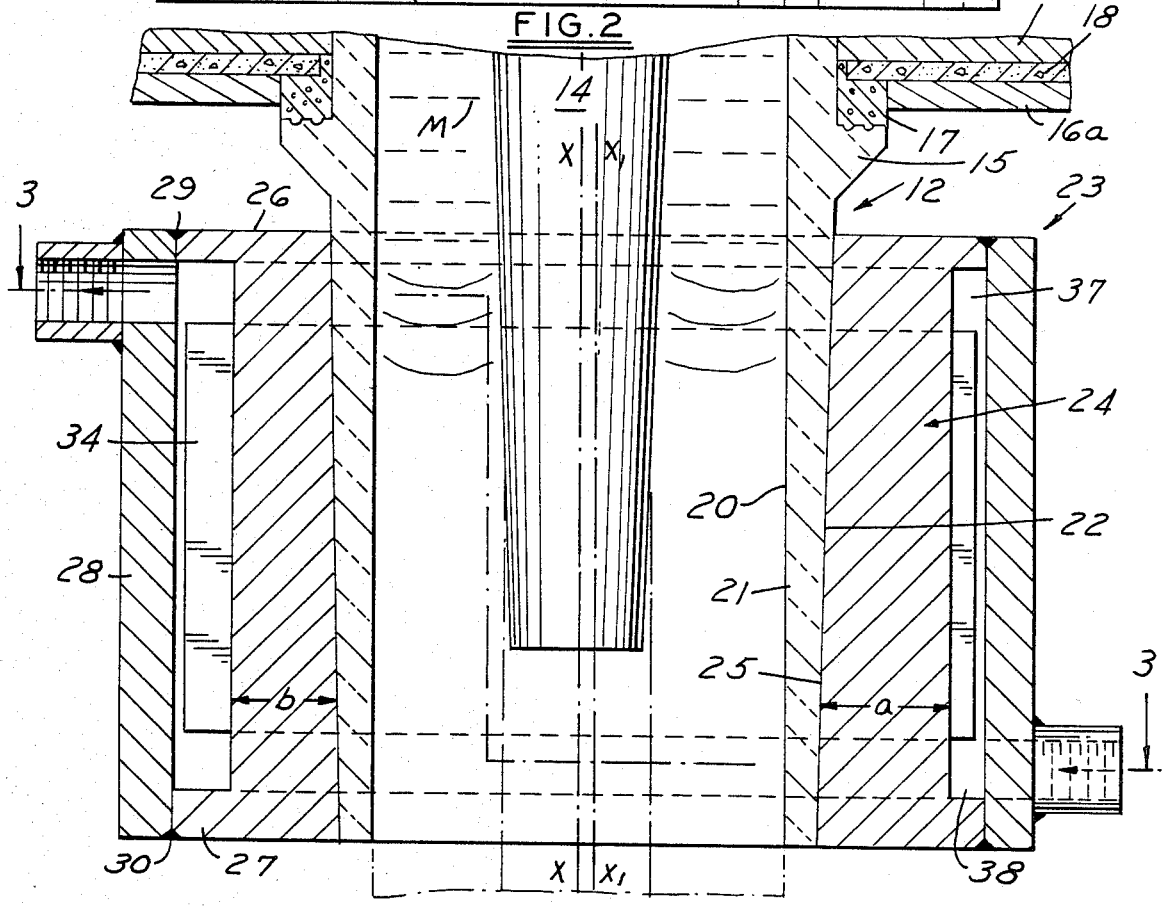
FIG. 2 is a fragmentary vertical sectional view of a portion of the apparatus shown in FIG. 1.
Figure 3:
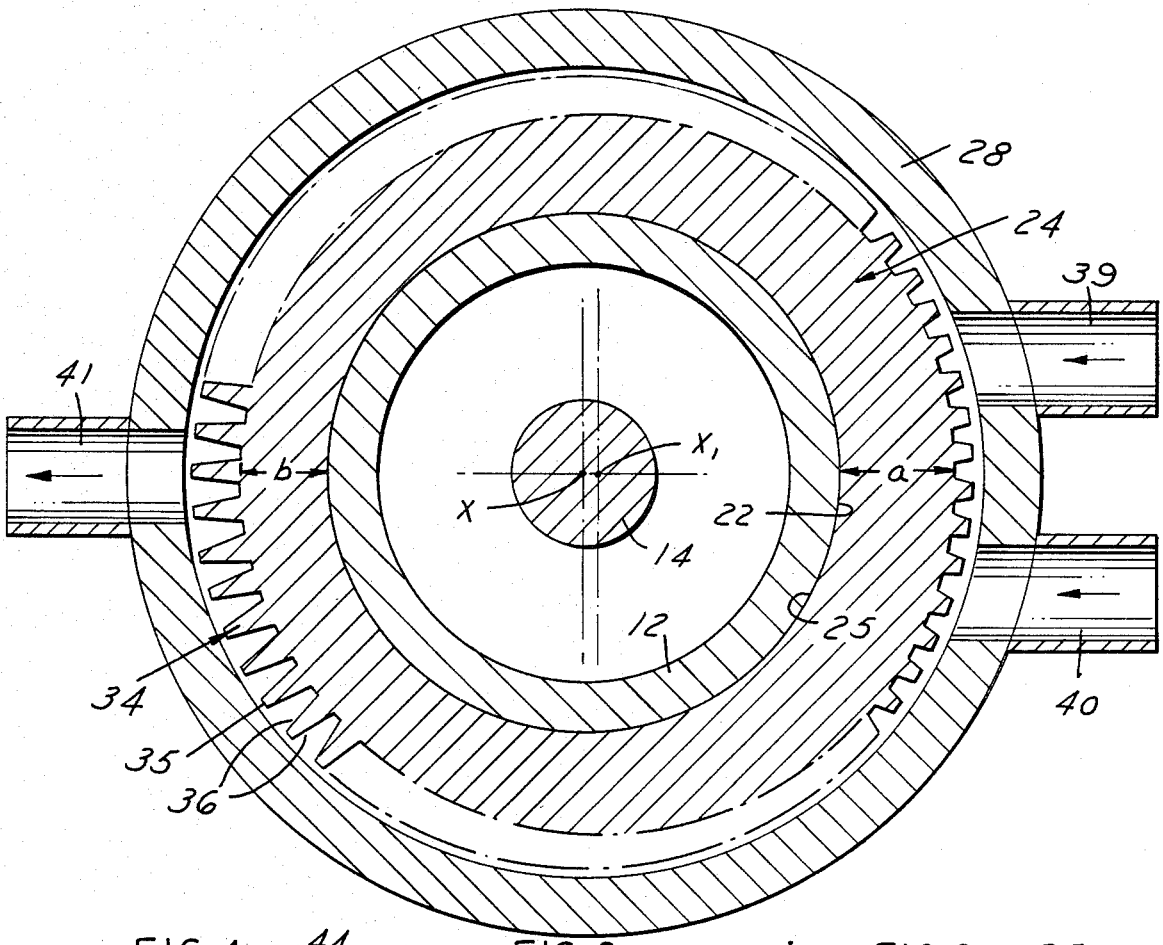
FIG. 3 is a sectional view taken along the line 3—3 in FIG. 2.
Figure 4:
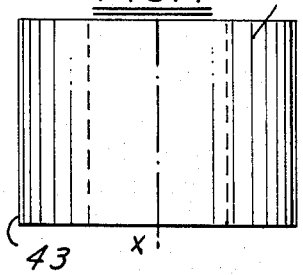
FIGS. 4–9 are successive views of the making of the cooling sleeve.
Figure 6:
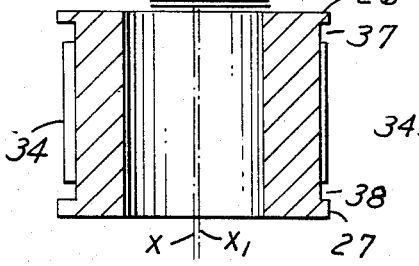
Figure 8:
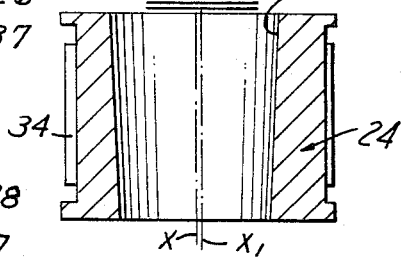
Figure 5:
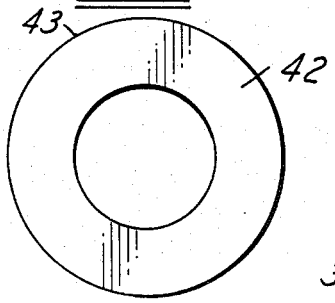
Figure 7:
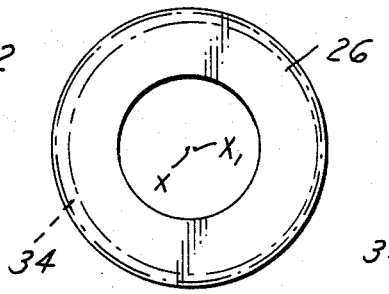
Figure 9:
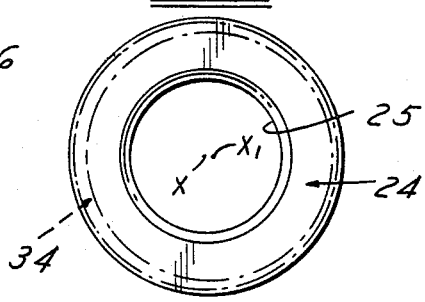

More specifically, the bases of the ribs 34 lie on a cylinder of the sleeve which has its axis or centerline $X_1$ spaced from the common axis or centerline X of the tapered surface 25 and the internal surface of shell 28 being nearer the inlets than the axis X. As a result the height of the ribs 28 increases progressively from the area of the inlet to the area of the outlet and the wall thickness a, b, of the cooling sleeve 24 decreases progressively from the area of the inlet to the area of the outlet to provide more uniform cooling zones around the material being cast (FIGS. 2, 3).

Where the die diameter is large the cylinder sleeve 24 is made from a cylindrical forging or body 42 which is first formed with cylindrical surface 43, grooves to form the chambers 37, 38 and flanges 26, 27, all having the same centerline X as the opening 44 in the body 42. The ribs 34 are then formed by mounting the body 42 for rotation about axis $X_1$ spaced from and parallel to the axis X of the cylindrical surface 43. The cooling sleeve is then rotated about axis X and the tapered surface 25 is formed (FIGS. 8, 9). Finally, the cooling sleeve 24 is inserted in the shell 28, which has the internal surface thereof concentric with the axis X, or centerline of the opening in sleeve 24 and the cylindrical outer surface of the sleeve 24. The shell and sleeve are fastened together by welding as at 29, 30 or other fastening means.

Where the die diameter is small, the cooling sleeve can be formed from a solid body and the opening therein formed in a later step of method.

In use, coolant such as water is caused to flow continuously through the inserts 39, 40 filling the lower annular chamber 38 and flowing in a thin layer upwardly along the entire inside surface of the shell 28 and the plurality of paths axially upwardly along all the surfaces of the ribs 34 and the shell 28 to the upper annular chamber 37 and then through the outlet 41. This causes the molten metal to solidify at the same time in the same horizontal diametrical plane at a predetermined level along the mandrel to thus ensure precise dimensioning of the internal passage of the casting while achieving uniform strength and grain structure that is free of surface imperfections caused by uneven cooling and solidification of residual molten metal remaining on the forming die. A high quality product is thus produced.

The uniform array of the ribs 34 of progressively increasing height from the inlet to the outlet not only uniformly extracts the heat at all levels of the die, it also increases the radiating area of heat dissipation and thus it accelerates the heat transfer to the cooling fluid. This, of course, allows the rate of production to be increased and at the same time, the achievement of a high quality product.

The cooling sleeve 24 with the extended vertical ribs 34 are preferably fabricated from high conductivity deoxidized copper which is well-known for its superior thermoconductivity. The vertical ribs 34 not only increase the cooling areas of the copper sleeve 24 but serve also as a restrictor to minimize the expansion of the sleeve 24 during the operation so the graphite die 12 is maintained in intimate contact with the cooling areas of the copper sleeve 24. The water circulating on the outside of the ribs 34 cools them more than the inside area and thus provides superior holding power to resist the deformation of the cooling sleeve 24. The cooling fluid as it circulates from the lower portion of the cooling sleeve 24 over the vertical ribs 34 forms a plurality of columns of water with varying temperatures. As the water contacts the tips of the vertical ribs 34 the heat transferred to the water has the tendency to prevent the expansion of the cooling sleeve 24 so there is no deformation of the contacting area between the die and the cooling sleeve. The outer surface of the vertical water columns and the layer of water between the tips 35 of the ribs 34 and shell 28 also cools the shell which holds the cooling sleeve 24 and restricts expansion.

The structure thus effectively cools the tubular die 12 uniformly and at the same time prevents the heat from excessively heating shell 28 so that even though the sleeve 24 and shell 28 are made of different materials, there will be no detrimental differential expansion between the two parts.

What is claimed is:

1. In a continuous casting apparatus wherein molten metal flows through a die progressively and is solidified in the die and withdrawn from the die, a die and cooling assembly comprising a tubular die having opposite inlet and outlet ends and an external tapered surface which is uniformly tapered radially inwardly towards the outlet end of the die, a cooling sleeve having a longitudinal axis, and an internal surface complementary to the external surface of the die and in substantial intimate surface contact with the external surface of said die, an annular cooling shell surrounding said cooling sleeve and having portions thereof spaced from said sleeve to define a cooling chamber, at least one coolant inlet into the chamber for admitting coolant into the chamber, at least one coolant outlet from said chamber for discharging coolant from the chamber, said inlet and said outlet being spaced along the axis of the sleeve with the outlet being nearest the inlet end of the die into which the molten metal flows, means forming a first annular coolant chamber about the sleeve in the region of and in communication with said coolant inlet, means forming a second annular coolant chamber in the region of and in communication with said coolant outlet, said cooling sleeve having a body and a plurality of circumferentially spaced integral ribs extending longitudinally along the body and extending radially outwardly from the body in spaced relation to the inner surface of said cooling shell such that in use coolant flows from the coolant inlet about said first annular coolant chamber along the inner surface of the cooling shell and in a plurality of axial paths along the surfaces of said ribs, about said second annular chamber and then through said coolant outlet.

2. The apparatus set forth in claim 1 wherein said cooling shell has a cylindrical inner surface and said ribs have outer ends defining a cylindrical surface spaced from but in close proximity to the inner surface of said cooling shell.

3. The apparatus set forth in claim 2 wherein the height of the ribs measured radially of the body of the sleeve increases progressively circumferentially of the sleeve from one side of the sleeve where the coolant inlet is located to the opposite side of the sleeve.

4. The apparatus set forth in claim 1 wherein the height of the ribs measured radially of the body of the sleeve increases progressively circumferentially of the sleeve from one side of the sleeve where the coolant inlet is located to the opposite side of the sleeve.

5. The apparatus set forth in claim 4 wherein the inner surface of the cooling shell and the internal surface of the cooling sleeve have a common axis and the ribs have bases defining a cylinder having an axis spaced in the direction of said coolant inlet from and parallel to said common axis such that the radial dimension of the body of the sleeve at the rib bases gradually decreases circumferentially in opposite directions from said one side of the sleeve to the opposite side of the sleeve as the radial height of the ribs increases.

6. The apparatus set forth in claim 4 including a pair of coolant inlets spaced on opposite sides of a radial plane intersecting the axis of said cooling sleeve such that coolant flowing inwardly through said inlets is directed in opposite directions about said first annular coolant chamber.

7. The apparatus set forth in claim 6 wherein said coolant outlet extends radially along said radial plane.

8. In continuous vertical casting apparatus for casting cylindrical products, wherein molten metal flows downwardly along a vertical axis through a die progressively and is solidified in the die and withdrawn from the die as a finished casting product, a die and cooling assembly comprising a tubular die having an upper inlet end and a lower outlet end for molten metal and having an external tapered surface which is uniformly tapered radially inwardly in the direction of movement of metal through the die from the inlet end to the outlet end, a tubular cooling sleeve having an internal surface complementary to the external surface of the die and in substantial intimate surface contact with the external surface of said die, a cooling shell having an inner surface surrounding said cooling sleeve and having portions thereof spaced from said sleeve to define a cooling chamber, said cooling shell having at least one coolant inlet to said chamber, and at least one coolant outlet from said chamber, said coolant inlet and said coolant outlet being vertically spaced with the outlet being nearest the inlet end of the die into which the molten metal flows, said cooling sleeve having a plurality of circumferentially spaced integral axially extending ribs extending radially outwardly therefrom in spaced relationship to the inner surface of said cooling shell.

the height of the ribs increasing progressively circumferentially in opposite circumferential directions from one side thereof where the coolant inlet is located to the opposite side of the sleeve, said cooling sleeve having upper and lower annular flanges extending radially outwardly from the cooling sleeve above and below said ribs, said ribs having opposite upper and lower ends spaced from said flanges respectively to define upper and lower annular secondary chambers in said cooling sleeve between said flanges and the adjacent ends of said ribs, said secondary chambers being adjacent to and communicating with said coolant inlet and coolant outlet respectively, and said ribs extending continuously between said upper and lower ends thereof such that coolant flows from the coolant inlet to the lower secondary chamber then circumferentially in opposite directions in said secondary chamber and thereafter along the inner surface of the cooling shell and in a plurality of axial paths along the surfaces of said ribs to the upper secondary chamber and then discharges through the coolant outlet whereby as the coolant increases in temperature in moving over the cooling sleeve from the coolant inlet to the coolant outlet, a progressively greater cooling area is more uniformly presented commensurate with the increase in the temperature of the coolant and the increased temperatures of the coolant sleeve as it approaches the inlet of the die where the metal to be cast is at molten temperature.

9. The apparatus defined in claim 8 further including a mandrel positioned within the die and having a vertical axis concentric to the axis of the die and having an outer downwardly converging conical surface spaced from the die to define an annular space for receiving molten metal and casting the same into a tubular product, and wherein the flow path of the coolant in the coolant chamber and about and along the cooling sleeve ensures that the cast product leaves the mandrel at a predetermined diametrical plane across the mandrel to ensure that the cast product is formed with a predetermined inside diameter.

10. The apparatus defined in claim 8 wherein said ribs have bases and wherein the radial cross-sectional thickness of the cooling sleeve measured to the bases of the ribs is greatest at said one side thereof and gradually decreases circumferentially in both directions to said opposite side of the sleeve.

11. The apparatus defined in claim 10 wherein said upper and lower secondary chambers gradually increase in radial dimension circumferentially in both directions from said one side of the cooling sleeve to said opposite side thereof.

12. The apparatus defined in claim 11 wherein said ribs have outermost surfaces uniformly spaced from in close proximity to the inner surface of said cooling shell.

13. The apparatus defined in claim 9 wherein said ribs have outermost surfaces uniformly spaced from the inner surface of said cooling shell, and wherein the height of each rib is uniform throughout the length of the rib.

14. The apparatus defined in claim 12 wherein the inner surface of the cooling shell and the outermost surfaces of the ribs define concentric cylinders.

15. The apparatus defined in claim 14 wherein said flanges have outer cylindrical surfaces engaged against the inner surface of the cooling shell.

16. For use in a cooler assembly for cooling dies in a continuous casting operation; a cooling sleeve of high thermal conductivity having opposite ends and an internal surface tapered from one end to the other end thereof to match the taper of a die to be seated within the cooling sleeve in intimate continuous surface contact therewith, said sleeve having a longitudinal central axis extending through said opposite ends thereof with the axis of the tapered internal surface coinciding with the axis of the sleeve, said sleeve including a body and a plurality of ribs integrally projecting in a radial direction from circumferentially spaced locations on the body while extending continuously longitudinally of the body between the opposite ends thereof to define a plurality of coolant flow paths extending between the opposite ends of the body at circumferentially spaced locations about the body, said ribs having heights measured in the radial direction of the sleeve which heights gradually increase in both directions circumferentially of the sleeve from one side of the sleeve to the opposite side of the sleeve to thereby increase the surface areas of the ribs and the areas of the coolant flow paths from said one side to said opposite side of the sleeve.

17. The cooling sleeve defined in claim 16 wherein the radial thickness of said body gradually decreases from said one side to said opposite side of said sleeve.

18. The cooling sleeve defined in claim 17 wherein the height of each rib is uniform throughout the length of the rib.

19. The cooling sleeve defined in claim 16 further including a pair of upper and lower cylindrical flanges projecting radially outwardly from the body of the sleeve at the opposite ends thereof respectively, said flanges defining annular recesses providing coolant flow paths about said sleeve at opposite ends of said ribs.

20. The cooling sleeve defined in claim 19 wherein said annular recesses gradually increase in radial dimension from said one side to said opposite side of the sleeve.

21. The cooling sleeve defined in claim 20 wherein the opposite ends of said ribs are spaced from said flanges respectively and wherein said coolant flow paths formed by said ribs communicate with said annular recesses at the opposite ends of said ribs.

22. The cooling sleeve defined in claim 21 wherein the radial thickness of said body gradually decreases from said one side to said opposite side of said sleeve, and wherein the height of each rib is uniform throughout the length of the rib.

* * * * *